US005785591A

United States Patent [19]

Payne

[11] Patent Number: 5,785,591

[45] Date of Patent: Jul. 28, 1998

[54] MOBILE SAFETY STRUCTURE WITH SEPARATE COMPARTMENTS FOR CONTAINMENT AND HANDLING OF HAZARDOUS MATERIALS

[75] Inventor: Edward Payne, Fairfax, Va.

[73] Assignee: The United States of America as represented by the Secretary of the Navy, Washington, D.C.

[21] Appl. No.: 813,266

[22] Filed: Jan. 7, 1997

[51] Int. Cl.[6] ..... B65D 81/18

[52] U.S. Cl. ..... 454/118; 220/1.5; 454/91

[58] Field of Search ..... 62/239; 220/1.5; 312/317.1; 454/79, 88, 90, 91, 118, 252

[56] References Cited

U.S. PATENT DOCUMENTS

| | | | |
|---|---|---|---|
| 4,875,595 | 10/1989 | Van Valkenburgh | 220/1.5 |
| 5,167,098 | 12/1992 | Blackwelder | 52/90 |
| 5,254,798 | 10/1993 | Zoback | 588/259 |
| 5,356,206 | 10/1994 | Van Valkenburgh | 312/317.1 |
| 5,495,695 | 3/1996 | Elliott, Jr. | 52/20 |
| 5,511,908 | 4/1996 | Van Valkenburgh | 405/128 |
| 5,562,047 | 10/1996 | Forney et al. | 108/51.1 |

*Primary Examiner*—Harold Joyce

*Attorney, Agent, or Firm*—Melvin J. Sliwka; David S. Kalmbaugh

[57] ABSTRACT

A mobile safety structure with separate compartments for containment and handling of hazardous materials which includes a roof assembly, a base assembly having a containment pan, right side and left side walls and front and rear walls with the front and right side walls having at least one door allowing for access to the interior of the structure. A removable grating is also included in the mobile safety structure which rest atop the base assembly. The removable grating allows the user of the structure to remove hazardous materials from the containment pan by use of a pump, and to visually inspect the containment pan for hazardous materials. There is positioned within the structure four upstanding interior walls which extend from the roof assembly through the floor to a bottom plate of the base assembly to form five separate compartments and associated containment pans within the mobile safety structure's interior. Each interior wall has a fire proof door which allows access between adjacent compartments. The interior and exterior walls, and roof assembly provide a strong structural enclosure which allows the user of the structure to adapt the structure for use under varying climatic conditions. The interior and exterior walls, and roof also have at least a four hour fire rating.

20 Claims, 7 Drawing Sheets

MOBILE SAFETY STRUCTURE WITH SEPARATE COMPARTMENTS FOR CONTAINMENT AND HANDLING OF HAZARDOUS MATERIALS

BACKGROUND OF THE INVENTION

1. Field of the Invention

This invention relates generally to the handling of hazardous wastes and other hazardous materials. More specifically, the present invention is concerned with a new form of mobile safety containment unit with individual compartments for handling, distribution, storing and transporting hazardous materials.

2. Description of the Prior Art

The handling, storage and transport of hazardous materials, and particularly hazardous waste has become a problem of major proportions. Increased emphasis is being placed on the importance of assuring that solvents, lubricants, paint related products, and the like are stored with adequate safeguards. Increasingly, it is being recognized that even small spills and relatively minor leakages of the growing number of substances that are being referred to by the term "hazardous material" can detrimentally affect persons, property, plants, animals, ground water and other aspects of ecology and the environment. Moreover, in view of increasing concern about the lasting nature of the adverse effects that can result from spills and unchecked leakage of hazardous materials, the issue of transportation, storage and distribution of hazardous materials is receiving increasing attention by law-makers, by regulatory agencies, and by those who have been elected to govern and to enforce the laws and regulations relating to hazardous materials.

In the past, the standard form of container for the handling, storage and transportation of hazardous materials has been the 55 gallon steel drum. In transportation of hazardous materials using 55 gallon steel drums, the drums are easily ruptured if an accident occurs. A high impact against a gang of the drums in a truck accident, for example, can cause a sort of domino effect wherein sufficient impact is transferred to a great number of the drums to rupture the drums. This is due to the basic cylindrical shape of the drum as well as its relatively thin walled construction.

During transportation and storage of the drums another hazard which may occur when full drums are stacked which they frequently are because their shape clearly lends itself to stacking. In many instances the drums are stacked eight or nine tiers high. These drums often leak, with the leaking chemicals flowing down to mix with other chemicals below. In this situation, even if the individual chemicals are not in themselves particularly hazardous, an unknown and hazardous combination may result.

When using cylindrical drums there is another potential hazard in that the drums are inherently reusable, even if the drums are not intended for this purpose. Unwitting re-use with an incompatible chemical can cause an explosion or the creation of a dangerous, explosive, poisonous or otherwise hazardous combination. The inherent re-usability of cylindrical drums is a significant disadvantage. Cylindrical drums with explosive materials have been known to ignite and shoot through a building roof in the manner of a rocket. Explosive material can dry and harden from the outside in toward the center of the drum, leaving a hollow core which can act as a rocket nozzle. This is another inherent disadvantage in use cylindrical drums for the storage of explosive hazardous materials.

For these and other reasons, there remains a very genuine and real need for a well designed, heavy duty containment facility that appropriately will address today's increasing concern for the way in which hazardous materials are handled, transported and stored.

There is also a need for a hazardous material containment structure which allows the user to maintain an inventory of the hazardous materials being stored and maintained within the structure.

The above and other needs for a hazardous material containment structure were partially met by U.S. Pat. No. 5,511,908 which issued Apr. 30, 1996 to Norman S. Van Valkenburgh, Gary L. Van Valkenburgh and Edward Payne, with Edward Payne being the sole inventor of the present invention. U.S. Pat. No. 5,511,908 discloses a single self contained storage unit for the storing and handling of containers of hazardous materials which includes a secondary containment feature in the form of a base assembly having a containment pan. The base assembly of the storage unit also provides a framework for supporting a floor of removable grating which allows access to the containment pan. The storage unit further comprises front, rear and side walls and a roof of very sturdy construction employing interior and outer surface steel panels supported by a generally rectangular shaped tubular steel framework for each wall and the roof of the mobile safety structure. There is sandwiched between the interior and outer surface steel panels of each wall a pair of gypsum boards and R-19 fiberglass insulation. The fiberglass installation allows the user of the storage unit of U.S. Pat. No. 5,511,908 to adapt the structure for use under varying climatic conditions, while the gypsum board provides the structure with at least a four hour fire rating. The framework of the storage unit has corner fittings to receive dual wheel casters and a tow bar which in combination allow a tow truck to move the safety structure from a first location to a second location.

However, under certain conditions, such as the cleanup of a military installation having significant amounts of jet engine fuel, paints, corrosives, acids and other toxic materials, there is requirement for a containment facility large enough to handle and safely store these hazardous materials. In addition, since these facilities often cover several hundred square miles there is a need for a containment facility to be mobile allowing for its movement from one location to another location on the facility as conditions dictate. There is also a need to provide a fire proof compartmental mobile safety structure which allow hazardous materials and contaminants that are volatile when mixed to be stored separately.

Further, there is a need to provide for a relatively inexpensive and safe mobile hazardous material containment facility to keep cleanup cost under control while maintaining the safety and health of the personnel using the facility.

SUMMARY OF THE INVENTION

The structure of the present invention addresses the foregoing and other needs of hazardous material storage, handling and transportation by providing a environmentally safe mobile storage unit which has multiple storage compartments and which will provide a good service life and under circumstances of reasonable use, can be moved from site to site over the years as may be appropriate to address a series of different servicing needs.

The structure of the present invention includes a roof assembly, a base assembly having a containment pan, right side and left side walls with the left side wall having a sliding glass window and front and rear walls with the front and right side walls having at least one door allowing for access to the interior of the structure by its user. The roof assembly of the mobile safety structure has at each corner thereof a corner fitting which is adapted to receive lifting lug allowing a crane to load the structure onto a flatbed truck for movement of the mobile safety structure from a first location to a second location.

A removable fiberglass or the like grating is also included in the mobile safety structure which rest atop the base assembly. The removable grating allows the user of the structure to remove hazardous materials from the containment pan by use of, for example, a pump. The removable grating also allows the user of the mobile safety structure to visually inspect the interior of the containment pan for hazardous materials which may be contained therein.

There is positioned within the structure four upstanding interior walls which extend from the roof assembly through the floor to a bottom plate of the base assembly forming five separate compartments and associated containment pans within the interior of the mobile safety structure. Each interior wall has a fire proof door which allows access between adjacent compartments by the user of mobile safety structure. In addition, the doors allow a particular compartment to be sealed in the event a fire occurs in the compartment or spillage of a toxic chemical occurs in the compartment. The mobile structure further allows chemicals which when mixed together become volatile to be stored in separate compartments.

The interior and exterior walls, and roof assembly of the mobile safety structure provide for a strong structural enclosure which allows the user of mobile safety structure to adapt the structure for use under varying climatic conditions. The interior and exterior walls, and roof of the mobile safety structure also have at least a four hour fire rating. A better understanding of the mobile safety structure as well as a better recognition of its advantages and novel features will be afforded to those skilled in the art from a consideration of the following detailed description of the a preferred embodiment thereof.

DETAILED DESCRIPTION OF THE PREFERRED EMBODIMENT

Figure 1:
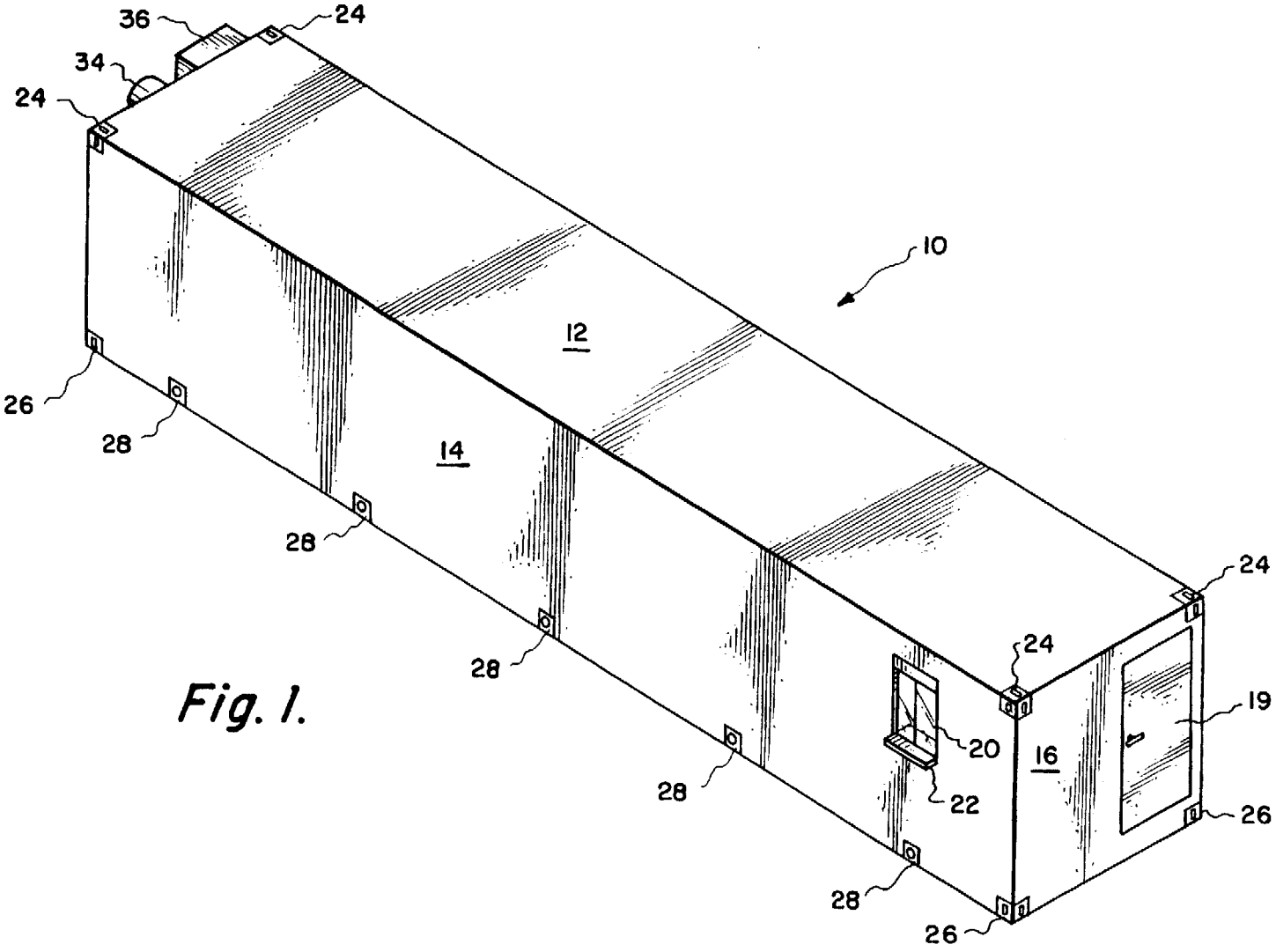
FIG. 1 is a perspective view of the mobile safety structure with separate compartments for containment and handling of hazardous materials which constitutes the present invention.
Figure 3:
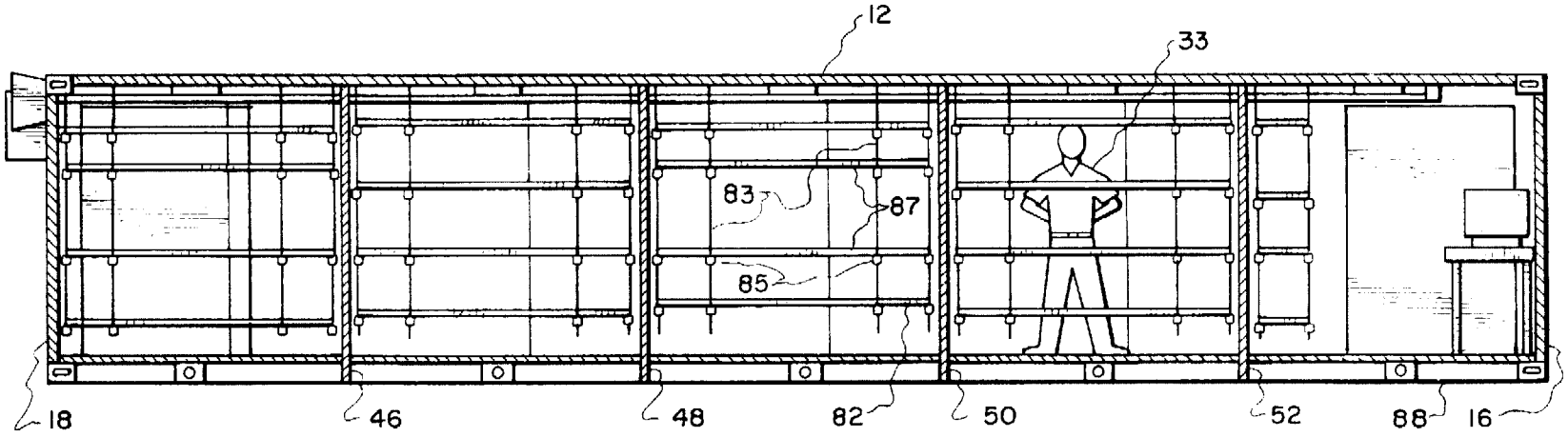
FIG. 3 is an interior view of the mobile safety structure of FIG. 1 taken from the left side wall of the mobile safety structure.
Figure 4:
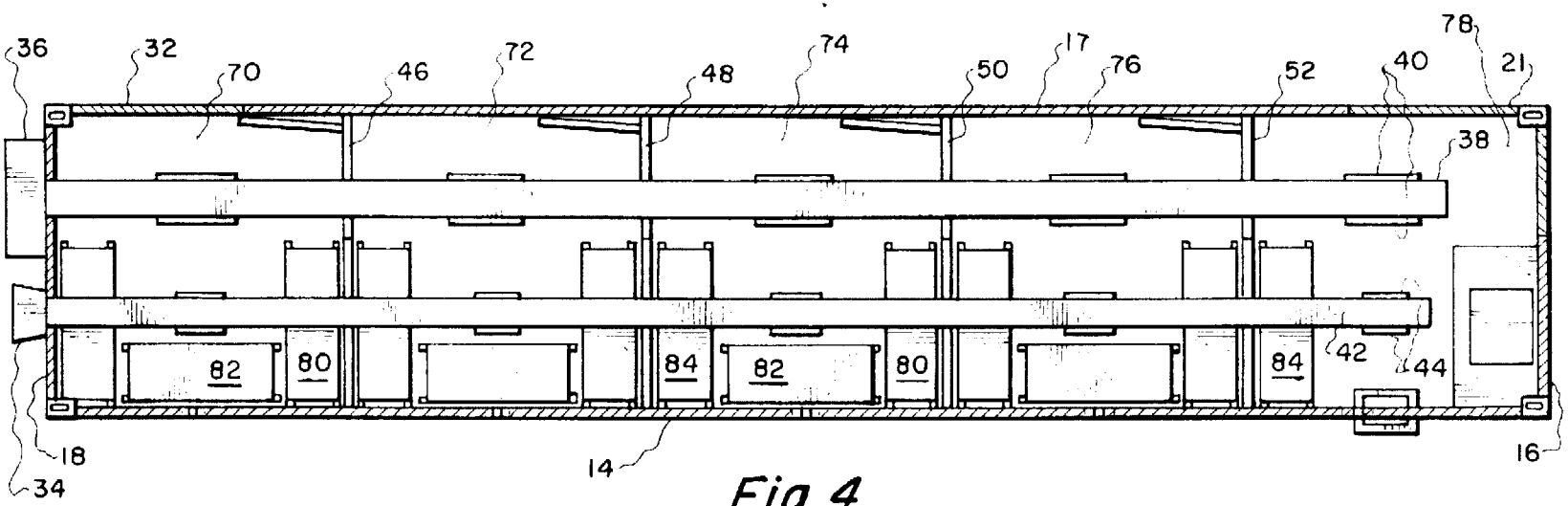
FIG. 4 is an interior view of the mobile safety structure of FIG. 1 taken from the roof of the mobile safety structure.

Referring to FIGS. 1, 3 and 4, there is shown a "mobile safety structure" or "containment structure" with multiple or separate compartments that represents the best mode carrying out the preferred practice of the present invention and is designated by the reference numeral 10. Mobile safety structure 10 has the general shape of a rectangular box like structure.

In overview, the mobile safety structure 10 has a base assembly 88 (FIG. 2*a*) or skid and an assembly of upstanding walls that is supported on base assembly 88. Mobile safety structure 10 also includes a roof assembly 12, that is supported atop the rectangularly shaped assembly of upstanding walls.

The assembly of upstanding walls consist of a right side wall 17, a left side wall 14, a front wall 16 and a rear wall 18. A door frame assembly 23 is incorporated into front wall 16 and pivotally mounts a door 19 which controls access to the interior of mobile safety structure 10.

A window frame structure and its associated sliding glass window 20 are incorporated in left side wall 14. Sliding glass teller window 20 may be opened and closed as required allowing the user 33 of mobile safety structure 10 to observe the environment outside of mobile safety structure 10 and also allows the user of structure 10 to communicate with individuals outside of structure 10. Sliding glass teller window 20 also a teller drawer 22 which allows an individual outside of mobile safety structure 10 to supply documents and the like to a user of structure 10 located in the interior portion of structure 10.

Figure 2A:
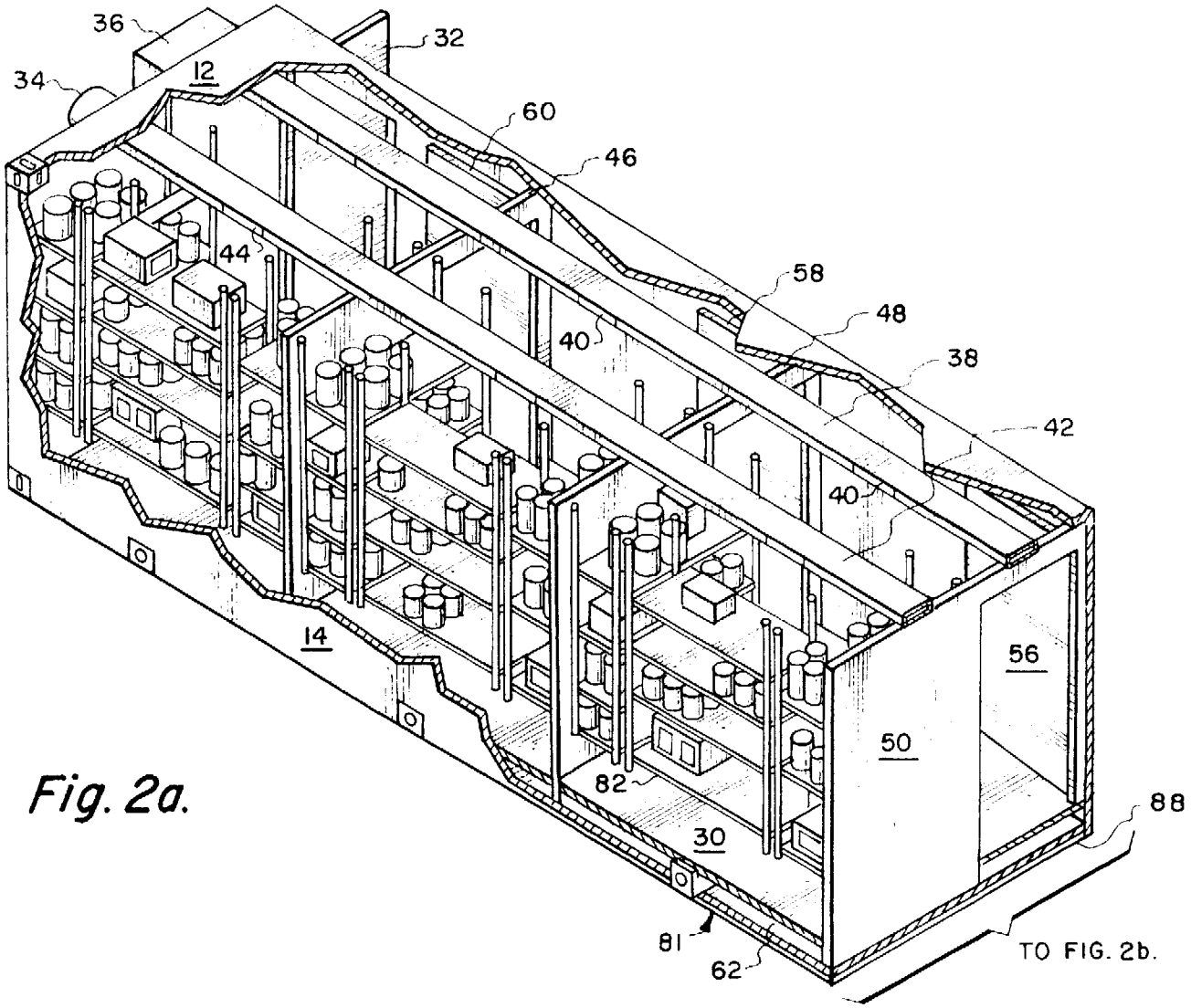
FIGS. 2*a* and 2*b* illustrate an interior perspective view of the mobile safety structure of FIG. 1.
Figure 2B:
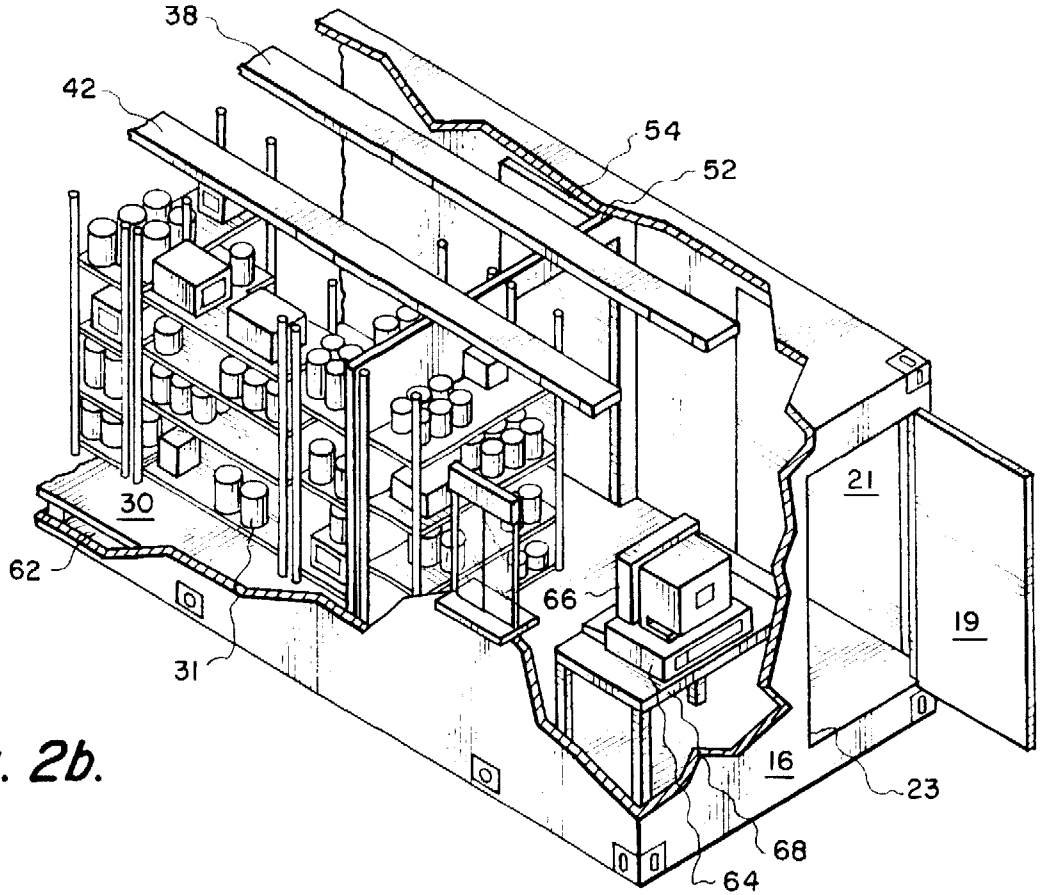

Referring to FIGS. 2*a*, 2*b* and 4, right side wall 17 includes a pair of doors 21 and 32 with door 21 being positioned at a front portion of side wall 17 and door 32 being positioned at a rear portion of side wall 17. Each door 21 and 32 has a door frame which pivotally mounts its associated door again controlling access to the interior portion of mobile safety structure 10.

As is best illustrated in FIGS. 2*a*, 2*b*, 3 and 4, the interior portion of mobile safety structure 10 includes five separate compartments 70, 72, 74, 76 and 78 for storing various types of hazardous materials and contaminants within the structure 10. Each compartment 70, 72, 74, 76 and 78 is formed by at least one upstanding interior wall 46, 48, 50 and 52, a portion of left side wall 14 and a portion of right side wall 17. Rear compartment 70 of structure 10 is formed by rear wall 18, interior wall 46 and a rear portion of left side wall 14 and right side wall 17. In a like manner, front compartment 78 is formed from front wall 16, interior wall 52 and a front portion of left side 14 and right side wall 16. Each compartment 70, 72, 74, 76 and 78 measures approximately eight feet in length, eight feet in width and eight feet in height. Mobile safety structure 10, in turn, has a length of approximately forty feet, a width of approximately eight feet and a height of approximately eight feet.

Each upstanding interior wall 46, 48, 50 and 52 of structure 10 includes a door and an associated door frame for pivotally mounting the door, with the doors for interior walls 46, 48, and 50 being identified respectively by the reference numerals 60, 58 and 56 (FIG. 2*a*) and the door for interior wall 52 (FIG. 2*b*) being identified by the reference numeral 54. Doors 54, 56, 58 and 60 allow the user 33 of structure 10 to access adjacent compartments during normal usage of structure 10. However, when a spillage of a hazardous material occurs in one compartment, such as compartment 74 the doors 56 and 58 which access compartment 74 may be closed by the user 33 of structure 10 to effectively seal compartment 74 from the remaining interior of structure 10. This allows for the continued use of structure 10 while the hazardous material spill is removed from compartment 10.

It should be noted that the inner walls 46, 48, 50 and 52, the left side wall 14, right side wall 17, front wall 16 and rear wall 18 may be fabricated from wall panels of 18 gauge steel plate and at least two stacked sheets of ¾ inch of ULTRA-CODE Core gypsum board fabricated by U.S. Gypsum Company of Chicago, Ill. Utilizing the double layer construction of gypsum board for the walls of mobile safety structure 10 provides for a four hour fire rating for each compartment 70, 72, 74, 76 and 78 of structure 10. In addition, the roof 12 of mobile safety structure 10 may also be fabricated from 18 gauge steel plate wall panels and stacked sheets of gypsum board. Conventional and commercially available doors with at least a four hour fire rating were used as interior doors 54, 56, 58 and 60 and exterior doors 19, 21 and 32 in the preferred embodiment of the present invention. The interior doors 54, 56, 58 and 60 each have an overlap (not illustrated) of approximately 1.5 inches to assist in fire containment within each of the compartments 70, 72, 74, 76 and 78 of mobile safety structure 10.

Referring to FIGS. 2*a*, 2*b*, 3 and 4, each compartment 70, 72, 74, and 76 includes three secondary containment shelves 80, 82 and 84 for the storage and handling of containers of hazardous materials, while compartment 78 has only secondary containment shelves 84 for the storage and handling of containers of hazardous materials. The secondary containment shelves 80, 82 and 84 may be suspended from the roof assembly 12 of mobile safety structure 10 in the manner best illustrated in FIG. 3.

As depicted in FIG. 3 when the secondary containment shelves 80, 82 and 84 are suspended from the roof assembly 12 of mobile safety structure 10, a plurality of support rods 83 affixed to roof assembly 12 are used to provide support for each shelf 87 of secondary containment shelves 80, 82 and 84. The support rods 83 are preferably constructed of steel and have a threaded exterior portion. Each shelf has a plurality of guide sleeves (not illustrated) which are to receive the support rods 83 which support that particular shelf. Lock nut assemblies 85 may comprise a hex nut and hex jam nut working in unison provide means for latitudinally adjusting each shelf 87 of the secondary containment shelves 80, 82 and 84 within the interior of mobile safety structure 10. Secondary containment shelves 80, 82 and 84 when supported from the roof assembly 12 facilitate retention of the containers of hazardous materials in such a manner as to substantially prevent spillage of the hazardous materials in the event of movement of mobile safety structure 10.

At this time it should be noted that each shelf 87 of containment shelves 80, 82 and 84 has a length of about 50 inches, a width of about 18 inches with a two inch containment lip around the exterior of each shelf. This provides for a shelf storage capacity of approximately 7.5 gallons of contaminants and hazardous materials. Each shelf 87 may also have a container restraint fabricated from one inch square nylon mesh netting which prevents containers 31 of hazardous materials from falling to floor 30 whenever there is a sudden movement of mobile safety structure 10.

Referring to FIGS. 3 and 4, there is mounted on the rear wall 18 of mobile safety structure 10 is a combination heater/air conditioner 36 which provides for a temperature controlled climate within the interior of mobile safety structure, thus allowing for the use of mobile safety structure in a warm weather climate such as the tropics or a cooled weather climate such as the Antarctic. Heater/air conditioner 36 is a forced air type system with independent exhaust for each compartment to prevent commingling of interior fumes from one compartment 70, 72, 74, 76 or 78 to another compartment 70, 72, 74, 76 or 78. Cool or hot air from heater/air conditioner 36 is forced through a duct work system 38 which has a separate duct (not illustrated) coupled to each compartment 70, 72, 74, 76 and 78 to a separate pair of vents 40 located within each compartment 70, 72, 74, 76 and 78.

There is mounted on the rear wall 18 of mobile safety structure 10 a fumer fan 34 which is used to withdraw fumes from airborne contaminants in each compartment 70, 72, 74, 76 and 78 of mobile safety structure 10. Fumer fan 34 includes a duct work system 42 which has a separate duct (not illustrated) coupled to each compartment 70, 72, 74, 76 and 78 to allow for the withdraw of fumes from a contaminated compartment 70, 72, 74, 76 or 78 without effecting the air in another compartment of mobile safety structure 10. The duct work system 42 also has a separate pair of exhaust vents 44 for each compartment 70, 72, 74, 76 and 78 for withdrawing contaminated air from the compartment which has contaminated air therein.

At this time it should be noted that the vents 40 and 44 in each compartment 70, 72, 74, 76 and 78 are explosion proof forced air type vents with fusible link dampers which close when interior temperatures reach about 165 degrees fahrenheit There is located in compartment 78 of mobile safety structure 10 a computer work station which includes computer 64 and its associated monitor 66 supported on work station desk 68. Computer 64 may be any conventional IBM compatible personal computer which may be used to keep a detailed record of the hazardous materials and contaminants stored in each compartment 70, 72, 74, 76 and 78 of mobile safety structure 10.

Referring to FIGS. 2*a*, 2*b* and 3, the preferred embodiment of mobile safety structure 10 contemplates a removable grating type structure 30 as a floor which rest upon floor support members (not illustrated). The removable grating structure 30 may be sectional to allow a particular portion of the grating structure 30 to be removed while maintaining the rest of the grating structure 30 as the floor of mobile safety structure 10. The removable grating structure 30 of mobile safety structure may be fabricated from a non-corrosive fire resistant structural steel, fiberglass or a like material which is not effected by extreme heat or cold or chemicals.

Containers of hazardous materials including, for example, 10 gallon drums 31 are stored within each compartment 70, 72, 74, 76 and 78 in mobile safety structure 10. These 10 gallon drums 31 may not be properly sealed which will cause spillage or leakage of contaminants and hazardous materials from drums 31. To facilitate, such spillage or leakage from the drums 31 within each compartment 70, 72, 74, 76 and 78 of mobile safety structure 10, a containment pan 62 is located below the removable grating which constitutes floor 30. The containment pan 62 is provided with a bottom which is a fire proof, corrosive resistant steel plate 81 running the length of mobile safety structure 10. Interior walls 46, 48, 50 and 52 extend below floor 30 to plate partitioning containment pan 62 into five separate sections, one for each compartment 70, 72, 74, 76 and 78 of mobile safety structure 10. Each shelf 87 within in each compartment 70, 72, 74, 76 and 78 has a drain plug located at its left front corner. When opened the drain plug allows the hazardous materials and contaminants stored by the shelf 87 to drain through the drain plug of each shelves 87 below it. The hazardous materials and contaminants then pass through the grating of floor 30 to containment pan 62.

By utilizing a removable grating as floor 30 within each compartment 70, 72, 74, 76 and 78 of structure 10, the user 33 of structure 10 may determine whether a spillage or leakage has occurred from containers stored within structure 30 by visually inspecting containment pan 62. The removable floor 30 within structure 10 also facilitates the removal of hazardous materials by a pump or the like from containment pan 62 should the hazardous materials be of such nature so as to warrant their removal from structure 10.

The five separate containment pans 62 for each compartment 70, 72, 74, 76 and 78 of structure 10 include a drain 28 which allows hazardous materials to be removed from a containment pan where spillage or leakage of a hazardous material has occurred. The five separate containment pans 62 for each compartment 70, 72, 74, 76 and 78 of structure 10 also have a storage capacity of about 242 gallons.

Figure 5:
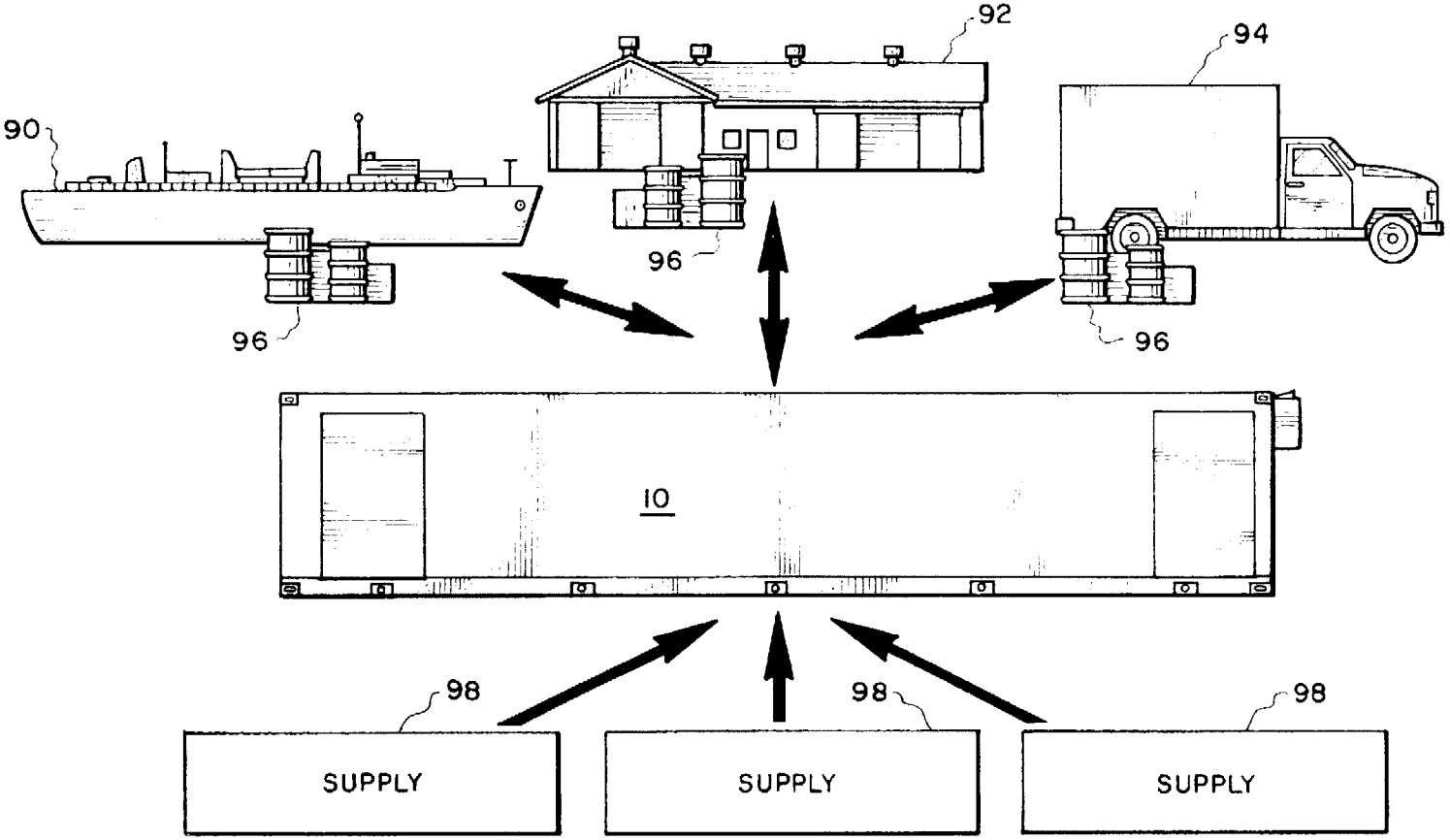
FIG. 5 illustrates a variety of environmental sites which may utilize the mobile safety structure of FIG. 1.
Figure 6:
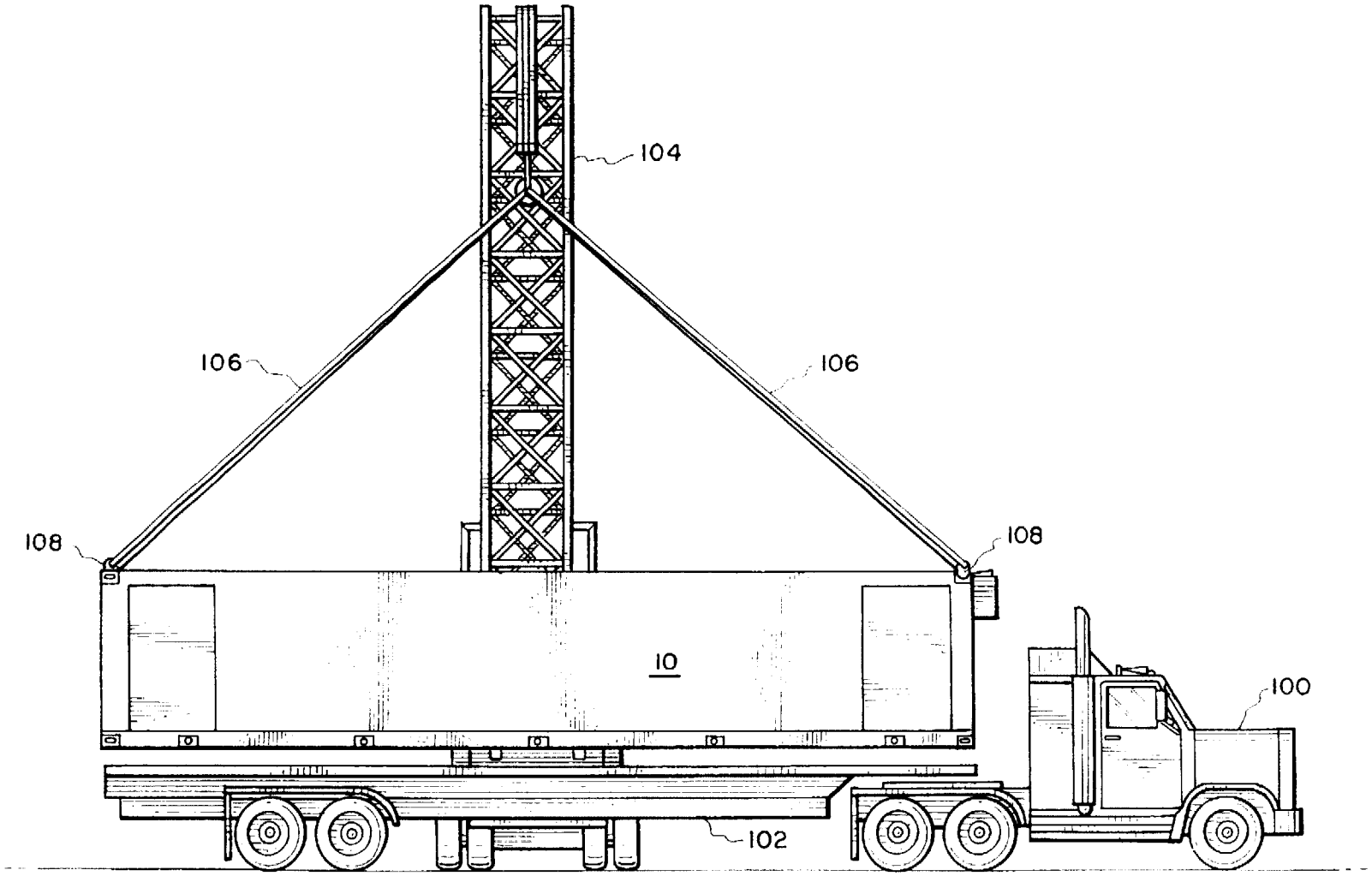
FIG. 6 illustrates the mobile safety structure being placed on a flatbed trailer for transportation to an environmentally hazardous site.

Referring to FIGS. 1, 5 and 6, there is located at each corner of the roof assembly 10 of mobile safety structure a corner fitting 24. Each corner fitting 24 is, in turn, adapted to receive a lifting lug/eyelet 108 which allow a cable 106 to be attached thereto. As is best illustrated by FIG. 6, when cables 106 are attached to the lifting lugs 108 at each corner of mobile safety structure 10, a crane 104 may be used to remove structure 10 from a fixed location and load structure 10 on a flatbed trailer 102 for transportation to a new contamination site. A truck 100 having flatbed trailer 102 attached thereto is used to transport to the new contamination site where mobile safety structure 10 will be used to clean up the site.

Base assembly 88 of safety structure 10 includes four identical wheel support assembles/corner fittings 26 with one corner fitting 26 being positioned at each corner of base assembly 88. Each corner fitting 26 is adapted to receive a dual wheel caster (not illustrated) which, when affixed to mobile safety structure 10 allows structure to be moved from one location to another location within, for example, a warehouse or an ocean going vessel. Four additional lift lugs 108 may affixed to roof assembly 12 for use in moving mobile safety structure 10 from one hazardous material location to another hazardous material location.

As is best illustrated in FIG. 5, mobile safety structure 10 may be transported from centrally located supply centers 98 to, for example, an ocean going vessel 90 or a land base hazardous materials facility 92. Mobile safety structure 10 may then be utilized to clean up leakage of hazardous materials from containers 96 used on board the vessel 90 or containers 96 located at the hazardous materials facility 92. Further, if, for example, a truck 94 transporting hazardous materials in containers 96 spills one or more of the containers 96 during transport, mobile safety structure 10 may be utilized to clean up these hazardous materials.

Although not illustrated in the FIGS. 1–6 of the drawings, interior lighting for mobile safety structure 10 comprises explosion proof florescent lights. In addition mobile safety structure 10 a portable generator affixed thereto to provide electrical power during power outages and at hazardous material cleanup sites where electrical power is not available. There is also included in the mobile safety structure 10 an emergency eyewash station (not illustrated) for treatment of the eyes whenever a hazardous material comes in contact with the eyes.

From the foregoing, it may readily be seen that the present invention comprises a new, unique and exceedingly useful mobile safety structure having multiple compartments for the containment and handling of hazardous materials which constitutes a considerable improvement over the known prior art. Obviously, many modifications and variations of the present invention are possible in light of the above teachings. It is therefore to be understood that within the scope of the appended claims the invention may be practiced otherwise than as specifically described.

What is claimed is:

1. A mobile safety structure for storing containers of hazardous materials and providing for a containment of any spills and leaks of said hazardous materials from said containers, said mobile safety structure comprising:

a rectangular base assembly;

first and second side walls extending perpendicularly upward from said base assembly;

a rear wall extending perpendicularly upward from said base assembly;

a front wall extending perpendicularly upward from said base assembly, one of each of said side walls being secured to a separate one of the opposed ends of said front wall and the other end of each of said side walls being secured to a separate one of the opposed ends of said rear wall to form a rectangular shaped assembly of upstanding walls;

a rectangular shaped roof assembly mounted atop said rectangular shaped assembly of upstanding walls and extending horizontally over an interior portion that is defined between said front and rear walls and between said first and second side walls;

said front wall having at least one front door to allow access to the interior portion of said mobile safety structure;

one of said first and second side walls having a pair of side doors to allow access to the interior portion of said mobile safety structure, a first of said pair of side doors being located at a rear portion of said one of said first and second side walls and a second of said pair of side doors being located at a front portion of said one of said first and second side walls;

said base assembly including a substantially rectangular open secondary containment pan that is leakproof, said secondary containment pan receiving spillage and leakage of said hazardous materials from said containers that are housed within said mobile safety structure;

a plurality of interior walls extending perpendicularly upward from a base plate of said base assembly to said roof assembly to form a plurality of interior compartments within the interior portion of said mobile safety structure;

each of said plurality of interior walls having a door to allow access between adjacent compartments of said plurality of interior compartments;

each of said plurality of interior compartments having a plurality of secondary containment shelves for storing said containers of hazardous materials, said secondary containment shelves including a plurality of support rods suspended from said roof assembly above said secondary containment pan, said plurality of support rods providing support for said secondary containment shelves free of engagement with said side, rear and front walls and said plurality of interior walls so as to facilitate retention of said containers on said secondary containment shelves;

said plurality of interior walls partitioning said secondary containment pan into a plurality of sub-secondary containment pans, each of said plurality of sub-secondary containment pans being positioned below an associated one of said plurality of interior compartments to receive spillage and leakage of said hazardous materials from said containers that are housed within said mobile safety structure; and a removable grating type floor supported by said base assembly and resting upon said base assembly, said removable grating type floor extending substantially horizontally atop each of said plurality of sub-secondary containment pans of said secondary containment pan.

2. The mobile safety structure of claim 1 further comprising a heater/air conditioner for providing a temperature controlled climate within the interior portion of said mobile safety structure, said heater/air conditioner being affixed to an outer portion of said rear wall, said heater/air conditioner including a duct work system coupled to each said plurality of interior compartments, said duct work system having a pair of climate control vents located within each of said plurality of interior compartments.

3. The mobile safety structure of claim 1 further comprising a fumer fan for withdrawing fumes resulting from spillage and leakage of said hazardous materials within each of said plurality of interior compartments of said mobile safety structure, said fumer fan being affixed to an outer portion of said rear wall, said fumer fan including a duct work system coupled to each of said plurality of interior compartments, said duct work system having a pair of exhaust vents located within each of said plurality of interior compartments.

4. The mobile safety structure of claim 1 further comprising a computer located within the interior protion of said mobile safety structure, said computer being utilized to keep a record of said hazardous materials stored in each of each of said plurality of interior compartments of said mobile safety structure.

5. The mobile safety structure of claim 1 wherein said removable grating type floor comprises a fiberglass grating type floor.

6. The mobile safety structure of claim 1 wherein each of said plurality of sub-secondary containment pans has a drain which allows said hazardous materials to be removed from said plurality of sub-secondary containment pans whenever spillage and leakage of said hazardous material occurs.

7. A mobile safety structure for storing containers of hazardous materials and providing for a containment of any spills and leaks of said hazardous materials from said containers, said mobile safety structure comprising:

a rectangular base assembly;

first and second side walls extending perpendicularly upward from said base assembly;

a rear wall extending perpendicularly upward from said base assembly;

a front wall extending perpendicularly upward from said base assembly, one of each of said side walls being secured to a separate one of the opposed ends of said front wall and the other end of each of said side walls being secured to a separate one of the opposed ends of said rear wall to form a rectangular shaped assembly of upstanding walls;

a rectangular shaped roof assembly mounted atop said rectangular shaped assembly of upstanding walls and extending horizontally over an interior portion that is defined between said front and rear walls and between said first and second side walls;

said front wall having at least one front door to allow access to the interior portion of said mobile safety structure;

one of said first and second side walls having a pair of side doors to allow access to the interior portion of said mobile safety structure, a first of said pair of side doors being located at a rear portion of said one of said first and second side walls and a second of said pair of side doors being located at a front portion of said one of said first and second side walls;

said base assembly including a substantially rectangular open secondary containment pan that is leakproof, said secondary containment pan receiving spillage and leakage of said hazardous materials from said containers that are housed within said mobile safety structure;

first, second and third interior walls extending perpendicularly upward from a base plate of said base assembly to said roof assembly to form first, second, third, fourth and fifth interior compartments within the interior portion of said mobile safety structure;

each of said first, second and third interior walls having a door to allow access between adjacent compartments of said first, second, third, fourth and fifth interior compartments;

said first, second and third interior walls partitioning said secondary containment pan into first, second, third, fourth and fifth sub-secondary containment pans, each of said first, second, third, fourth and fifth sub-secondary containment pans being positioned below an associated one of said first, second, third, fourth and fifth interior compartments to receive spillage and leakage of said hazardous materials from said containers that are housed within said mobile safety structure; and a removable grating type floor supported by said base assembly and resting upon said base assembly, said removable grating type floor extending substantially horizontally atop each of said first, second, third, fourth and fifth sub-secondary containment pans of said secondary containment pan.

8. The mobile safety structure of claim 7 wherein each of said first, second, third, fourth and fifth sub-secondary containment pans of said secondary containment pan has a storage capacity of about 242 gallons.

9. The mobile safety structure of claim 7 wherein said removable grating type floor comprises a fiberglass grating type floor.

10. The mobile safety structure of claim 7 wherein each of said first, second, third, fourth and fifth sub-secondary containment pans has a drain which allows said hazardous materials to be removed from said first, second, third, fourth and fifth sub-secondary containment pans whenever spillage and leakage of said hazardous material occurs.

11. The mobile safety structure of claim 7 wherein each of said first, second, third, fourth and fifth interior compartments has a four hour fire rating.

12. The mobile safety structure of claim 7 further comprising a heater/air conditioner for providing a temperature controlled climate within the interior portion of said mobile safety structure, said heater/air conditioner being affixed to an outer portion of said rear wall, said heater/air conditioner including a duct work system coupled to each said first, second, third, fourth and fifth interior compartments, said duct work system having a pair of climate control vents located within each of said first, second, third, fourth and fifth interior compartments.

13. The mobile safety structure of claim 7 further comprising a fumer fan for withdrawing fumes resulting from spillage and leakage of said hazardous materials within each of said first, second, third, fourth and fifth interior compartments of said mobile safety structure, said fumer fan being affixed to an outer portion of said rear wall, said fumer fan including a duct work system coupled to each of said first, second, third, fourth and fifth interior compartments, said duct work system having a pair of exhaust vents located within each of said first, second, third, fourth and fifth interior compartments.

14. The mobile safety structure of claim 7 further comprising a computer located within the interior protion of said mobile safety structure, said computer being utilized to keep a record of said hazardous materials stored in each of each of said first, second, third, fourth and fifth interior compartments of said mobile safety structure.

15. A mobile safety structure for storing containers of hazardous materials and providing for a containment of any spills and leaks of said hazardous materials from said containers, said mobile safety structure comprising:

a rectangular base assembly;

first and second side walls extending perpendicularly upward from said base assembly;

a rear wall extending perpendicularly upward from said base assembly;

a front wall extending perpendicularly upward from said base assembly, one of each of said side walls being secured to a separate one of the opposed ends of said front wall and the other end of each of said side walls being secured to a separate one of the opposed ends of said rear wall to form a rectangular shaped assembly of upstanding walls;

a rectangular shaped roof assembly mounted atop said rectangular shaped assembly of upstanding walls and extending horizontally over an interior portion that is defined between said front and rear walls and between said first and second side walls;

said front wall having at least one front door to allow access to the interior portion of said mobile safety structure;

one of said first and second side walls having a pair of side doors to allow access to the interior portion of said mobile safety structure, a first of said pair of side doors being located at a rear portion of said one of said first and second side walls and a second of said pair of side doors being located at a front portion of said one of said first and second side walls;

said base assembly including a substantially rectangular open secondary containment pan that is leakproof, said secondary containment pan receiving spillage and leakage of said hazardous materials from said containers that are housed within said mobile safety structure;

first, second and third interior walls extending perpendicularly upward from a base plate of said base assembly to said roof assembly to form first, second, third, fourth and fifth interior compartments within the interior portion of said mobile safety structure;

each of said first, second and third interior walls having a door to allow access between adjacent compartments of said first, second, third, fourth and fifth interior compartments;

said first, second and third interior walls partitioning said secondary containment pan into first, second, third, fourth and fifth sub-secondary containment pans, each of said first, second, third, fourth and fifth sub-secondary containment pans being positioned below an associated one of said first, second, third, fourth and fifth interior compartments to receive spillage and leakage of said hazardous materials from said containers that are housed within said mobile safety structure;

each of said first, second, third, fourth and fifth sub-secondary containment pans having a drain which allows said hazardous materials to be removed from said first, second, third, fourth and fifth sub-secondary containment pans whenever spillage and leakage of said hazardous material occurs;

a removable grating type floor supported by said base assembly and resting upon said base assembly, said removable grating type floor extending substantially horizontally atop each of said first, second, third, fourth and fifth sub-secondary containment pans of said secondary containment pan;

a fumer fan for withdrawing fumes resulting from spillage and leakage of said hazardous materials within each of said first, second, third, fourth and fifth interior compartments of said mobile safety structure, said fumer fan being affixed to an outer portion of said rear wall, said fumer fan including a first duct work system coupled to each of said first, second, third, fourth and fifth interior compartments, said first duct work system having a pair of exhaust vents located within each of said first, second, third, fourth and fifth interior compartments; and a heater/air conditioner for providing a temperature controlled climate within the interior portion of said mobile safety structure, said heater/air conditioner being affixed to an outer portion of said rear wall, said heater/air conditioner including a second duct work system coupled to each said first, second, third, fourth and fifth interior compartments, said second duct work system having a pair of climate control vents located within each of said first, second, third, fourth and fifth interior compartments.

16. The mobile safety structure of claim 15 wherein each of said first, second, third, fourth and fifth sub-secondary containment pans of said secondary containment pan has a storage capacity of about 242 gallons.

17. The mobile safety structure of claim 15 wherein each of said first, second, third, fourth and fifth interior compartments has a plurality of secondary containment shelves for storing said containers of hazardous materials, said secondary containment shelves including a plurality of support rods suspended from said roof assembly above said secondary containment pan, said plurality of support rods providing support for said secondary containment shelves free of engagement with said side, rear and front walls and said interior walls so as to facilitate retention of said containers on said secondary containment shelves.

18. The mobile safety structure of claim 15 wherein said removable grating type floor comprises a fiberglass grating type floor.

19. The mobile safety structure of claim 15 wherein each of said first, second, third, fourth and fifth sub-secondary containment pans has a drain which allows said hazardous materials to be removed from said first, second, third, fourth and fifth sub-secondary containment pans whenever spillage and leakage of said hazardous material occurs.

20. The mobile safety structure of claim 15 wherein each of said first, second, third, fourth and fifth interior compartments has a four hour fire rating.

* * * * *